US006826946B2

(12) United States Patent
Muller et al.

(10) Patent No.: US 6,826,946 B2
(45) Date of Patent: Dec. 7, 2004

(54) FORMING MACHINE WITH A ROTATING WEDGED DISC

(75) Inventors: François Muller, Mulhouse (FR); Ulrich Steinhauser, Allschwil (CH)

(73) Assignee: Hatebur Umformmaschinen AG, Reinach (CH)

( * ) Notice: Subject to any disclaimer, the term of this patent is extended or adjusted under 35 U.S.C. 154(b) by 183 days.

(21) Appl. No.: 10/297,994

(22) PCT Filed: Jul. 17, 2001

(86) PCT No.: PCT/CH01/00444

§ 371 (c)(1),
(2), (4) Date: Dec. 12, 2002

(87) PCT Pub. No.: WO02/09898

PCT Pub. Date: Feb. 7, 2002

(65) Prior Publication Data

US 2003/0167820 A1 Sep. 11, 2003

(30) Foreign Application Priority Data

Aug. 2, 2000 (CH) ..... 1525/00

(51) Int. Cl.[7] ..... B21J 13/00

(52) U.S. Cl. ..... 72/446; 72/449; 72/482.8; 100/257

(58) Field of Search ..... 72/441, 446, 447, 72/448, 449, 481.1, 482.3, 482.4, 482.8; 100/257, 288, 291; 83/527

(56) References Cited

U.S. PATENT DOCUMENTS 3,889,515 A 6/1975 Grombka
3,991,681 A 11/1976 Antosiak
4,535,689 A * 8/1985 Putkowski ..... 100/214
4,555,966 A 12/1985 Klingel
4,732,032 A * 3/1988 Kogure ..... 72/389.5
4,790,173 A 12/1988 Boutcher, Jr.
4,898,015 A * 2/1990 Houston ..... 72/389.5
4,918,956 A * 4/1990 Schoch ..... 72/21.1
4,930,339 A * 6/1990 Corsini ..... 72/389.5
5,299,443 A * 4/1994 Nakamura ..... 72/446
5,467,707 A 11/1995 Kanamaru

FOREIGN PATENT DOCUMENTS

GB 1 497 092 1/1978

* cited by examiner

*Primary Examiner*—Ed Tolan
(74) *Attorney, Agent, or Firm*—Leydig, Voit & Mayer, Ltd.

(57) ABSTRACT

A forming machine according to the invention comprises at least one forming station having a punch and a die as tools and a device for setting the axial position of one of the two tools. The setting device has, as adjusting wedge, a rotary wedge disk which is rotatable about a rotation axis and bears with a bearing surface against a parent body. The rotary wedge disk is provided with an inclined plane on the other disk side. The setting device also comprises a pressure piece which is composed of a pressure part and a rotary part having an end face. The end face bears against the inclined plane in such a way that it is displaced relative to the rotary wedge disk eccentrically to the rotation axis when the rotary wedge disk is rotated, the axial distance between pressure piece and parent body changing in the process. Since the adjusting wedge is a rotary wedge disk, the bearing surface rotates on the parent body and is not displaced longitudinally during an adjustment.

10 Claims, 5 Drawing Sheets

A
B
C
D

FORMING MACHINE WITH A ROTATING WEDGED DISC

The present invention relates to a forming machine comprising at least one forming station having a punch and a die as tools and a device for setting the axial position of one of the two tools.

After the initial fitting or the exchange of the tools, i.e. of the punch and/or the die, in a forming station, it is often necessary to still accurately set their position so that the workpieces are exactly formed in the desired manner during the operation of the forming machine. In particular, the axial mutual position of the punch and the die must be correct during the forming, which can be achieved by setting the axial position of at least one of the two tools. Since the tools are subjected to high impact forces during the forming, the device for setting the axial position must be of accordingly robust design.

Setting devices which comprise a vertically displaceable adjusting wedge have therefore often been used up to now. A forming machine having such a setting device for each forming station is described, for example, in U.S. Pat. No. 4,898,017. The adjusting wedge, which in each case is displaceable in the vertical direction by means of a setting screw, bears with a bearing surface against a pressure plate, which is fastened to a slide via a further plate. The punch belonging to the forming station is supported via a plurality of intermediate elements on the other side of the adjusting wedge, this other side forming an inclined plane. The axial position of the punch is adjusted by vertical displacement of the adjusting wedge on account of the inclined plane of the latter.

However, a problem with such setting devices is that impression recesses produced in the pressure plate by the adjusting wedge may occur due to the high impact forces during the forming, these impression recesses, on the one hand, impairing an adjustment of the adjusting wedge and, on the other hand, encouraging the generation of bending fractures if the adjusting wedge comes to lie above an edge of an impression recess after a displacement. In addition, the introduction of force to the pressure plate and ultimately to the slide changes during a displacement of the adjusting wedge.

In view of the disadvantages of the hitherto known setting devices, described above, in forming machines, the object of the invention is as follows. A forming machine of the type mentioned at the beginning comprising at least one forming station having a punch and a die as tools and a device for setting the axial position of one of the two tools, in which forming machine the introduction of force to a parent body does not change substantially during an adjustment of the adjusting wedge, is to be provided. Here, the expression parent body refers in particular to the machine body, the machine body with pressure plate, the press slide, or the press slide with pressure plate. In addition, the risk of a fracture of the adjusting wedge is preferably to be avoided. Impression recesses which cannot be avoided are not to impair the adjustment of the adjusting wedge.

This object is achieved by the forming machine according to the invention.

The forming machine according to the invention comprises at least one forming station having a punch and a die as tools and a device for setting the axial position of one of the two tools, the device comprising an adjusting wedge having a bearing surface which bears against a parent body. The essence of the invention, then, consists in the fact that the adjusting wedge is a rotary wedge disk which is rotatable about a rotation axis and which has the bearing surface on one disk side and an inclined plane on the other disk side, and the device also comprises a pressure piece having an end face which bears against the inclined plane in such a way that it is displaced relative to the rotary wedge disk eccentrically to the rotation axis when the rotary wedge disk is rotated, the axial distance between pressure piece and parent body changing in the process.

Since the adjusting wedge is a rotary wedge disk which rotates during an adjustment, the bearing surface also rotates on the parent body and is not displaced longitudinally. As a result, the introduction of force to the parent body is not changed substantially during an adjustment of the adjusting wedge and is therefore more favorable than in the previous forming machines.

The bearing surface is preferably circular and rotates on the spot on the parent body when the rotary wedge disk is rotated. This means that the rotary wedge disk rotates in the impression recess possibly produced during the forming and never comes to lie above an edge of the impression recess. In this way, the risk of a fracture and the impairment of the adjustment of the adjusting wedge by impression recesses can be avoided or at least markedly reduced.

There is advantageously arranged on the rotary wedge disk a toothed rim, via which said rotary wedge disk can be rotated. On account of the drive of the rotary wedge disk via a toothed rim at the periphery, the bearing surface and the inclined plane are not impaired by drive elements.

There are preferably means for arresting the rotary wedge disk in each adjustable position. This can prevent unintentional rotation of the rotary wedge disk from being caused by the high impact forces occurring during the forming.

The angle of inclination of the inclined plane relative to the bearing surface is advantageously 10° at most. The angle of inclination is thus smaller than the limit angle for self-locking, as a result of which unintentional displacement of the end face on the inclined plane can be prevented.

The pressure piece preferably comprises a rotatable part having the end face and a rotationally fixed pressure part connected thereto via first sliding surfaces. During the adjustment of the rotary wedge disk, the rotary part with the end face can then be rotated at the same time, whereas the pressure part is only axially displaced, as a result of which the adjacent tool does not rotate.

In an advantageous embodiment variant, the first sliding surfaces have the form of a convex spherical-surface section and, respectively, a concave spherical-surface section complementary thereto. This has the advantage that it is not absolutely necessary for the rotary part to be rotated relative to the rotary wedge disk during an adjustment of the latter.

In an alternative exemplary embodiment, the rotary part comprises an end-face part having the end face and an articulation part connected thereto via second sliding surfaces and having one of the first sliding surfaces. The second sliding surfaces preferably have the form of a convex cylinder-envelope or spherical-surface section and, respectively, a concave cylinder-envelope or spherical-surface section complementary thereto. If the second sliding surfaces have the form of spherical-surface sections, it is not absolutely necessary for the rotary part to be rotated relative to the rotary wedge disk during an adjustment of the latter.

The forming machine according to the invention advantageously has means for rotating the rotary part or, if present, the articulation part coupled to the rotary wedge disk, these means preferably comprising a toothed rim which is arranged on the rotary part or, if present, on the articulation part. This ensures that the rotary part or the articulation part rotates together with the rotary wedge disk, as a result of which it can be ensured that the pressure piece does not tilt or that correct bearing of its end face against the inclined plane of the rotary wedge disk is maintained.

In an advantageous embodiment variant, the pressure piece and the rotary wedge disk have a through-hole and/or a curved through-slot for an ejector. There is preferably a central through-hole in the pressure piece or in part of the pressure piece, for example, if present, in the pressure part and possibly in the articulation part, and there is preferably a curved through-slot or a through-hole enlarged relative to the diameter of the ejector in the rotary wedge disk and the possible other parts of the pressure piece, so that an adjustment of the rotary wedge disk is possible despite the ejector.

The forming machine according to the invention having at least one device for setting the axial position of one of the tools is described in more detail below with reference to the attached drawings using four exemplary embodiments. In the drawings:

FIGS. 1*a*, 1*b* schematically show a setting device of a first exemplary embodiment of the forming machine according to the invention at full stroke in a side view and a plan view;

FIGS. 2*a*, 2*b* show the setting device at average stroke in a side view and a plan view;

FIGS. 3*a*, 3*b* show the setting device at O-stroke in a side view and a plan view;

Figure 11:
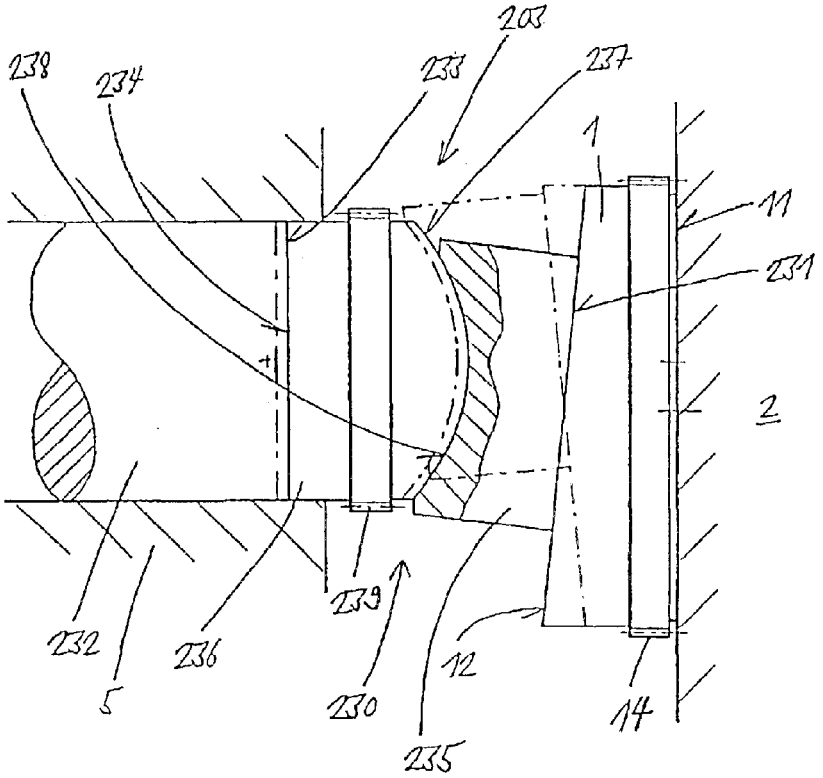
Figure 12:
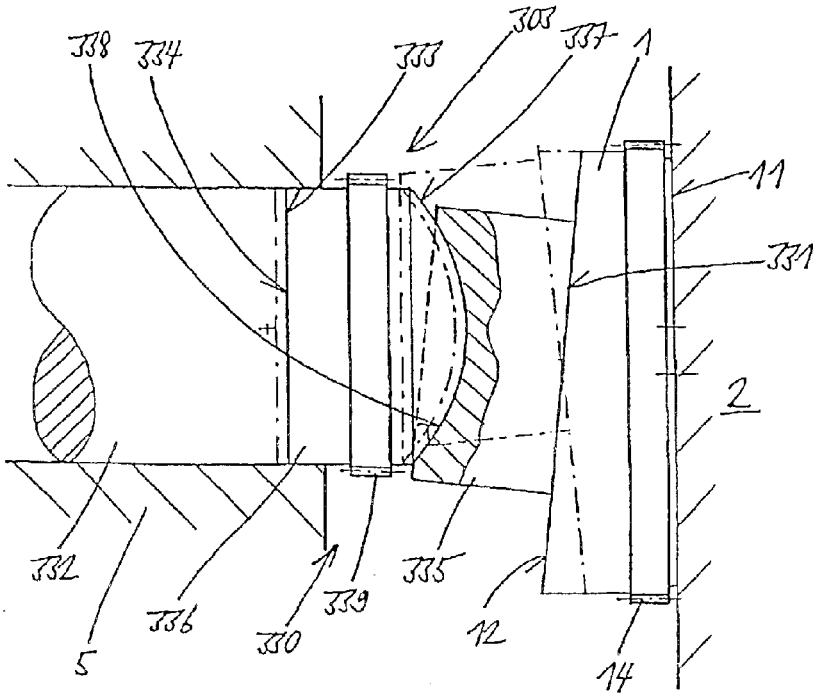

FIG. 11 shows a partial sectional view of part of the setting device arranged in the forming machine according to a third exemplary embodiment, having a rotary part comprising an articulation part and an end-face part which are connected via sliding surfaces in the form of cylinder-envelope sections; and FIG. 12 shows a partial sectional view of part of the setting device arranged in the forming machine according to a fourth exemplary embodiment, having a rotary part comprising an articulation part and an end-face part which are connected via sliding surfaces in the form of spherical-surface sections.

FIGS. 1*a* to 3*b*

In a first exemplary embodiment, a forming machine according to the invention, comprising at least one forming station having a punch and a die as tools, comprises a device for setting the axial position of one of the tools, this device having a rotary wedge disk 1 rotatable about a rotation axis 13 and a pressure piece 3 bearing against said rotary wedge disk 1. The rotary wedge disk 1 is provided on one disk side with a bearing surface 11 for bearing against a parent body and is provided on the other disk side with an inclined plane 12. The pressure piece 3 has an end face 31 which bears against the inclined plane 12 eccentrically to the rotation axis 13.

The axial position is set by rotating the rotary wedge disk 1 and the pressure piece 3, in the course of which the rotary wedge disk 1 and the pressure piece 3 are rotated by the same angle, so that the bearing surface 11 of the rotary wedge disk 1 and the end surface 41 of the pressure piece 3 do not change their orientation and parallelism. Since both the rotary wedge disk 1, with regard to its rotation axis 13, and the pressure piece 3, with regard to its rotation axis 42, should not or cannot be displaced by the arrangement in the forming machine, the end face 31 of the pressure piece 3 is displaced relative to the rotary wedge disk 1 eccentrically to the rotation axis 13 of the latter when the rotary wedge disk 1 and the pressure piece 3 are rotated.

In the present first exemplary embodiment, there is an ejector 4 passing through the setting device, the pressure piece 3 having a through-hole 40 and the rotary wedge disk 1 having a curved through-slot 15 for this purpose. When the rotary wedge disk 1 and the pressure piece 3 are rotated, the ejector 4 and the through-hole 40 remain on the spot, whereas the curved through-slot 15 is displaced relative to the ejector 4. The curved through-slot 15 permits a rotation of up to 180°.

Figures 1A, 1B, 2A, 2B, 3A, 3B:
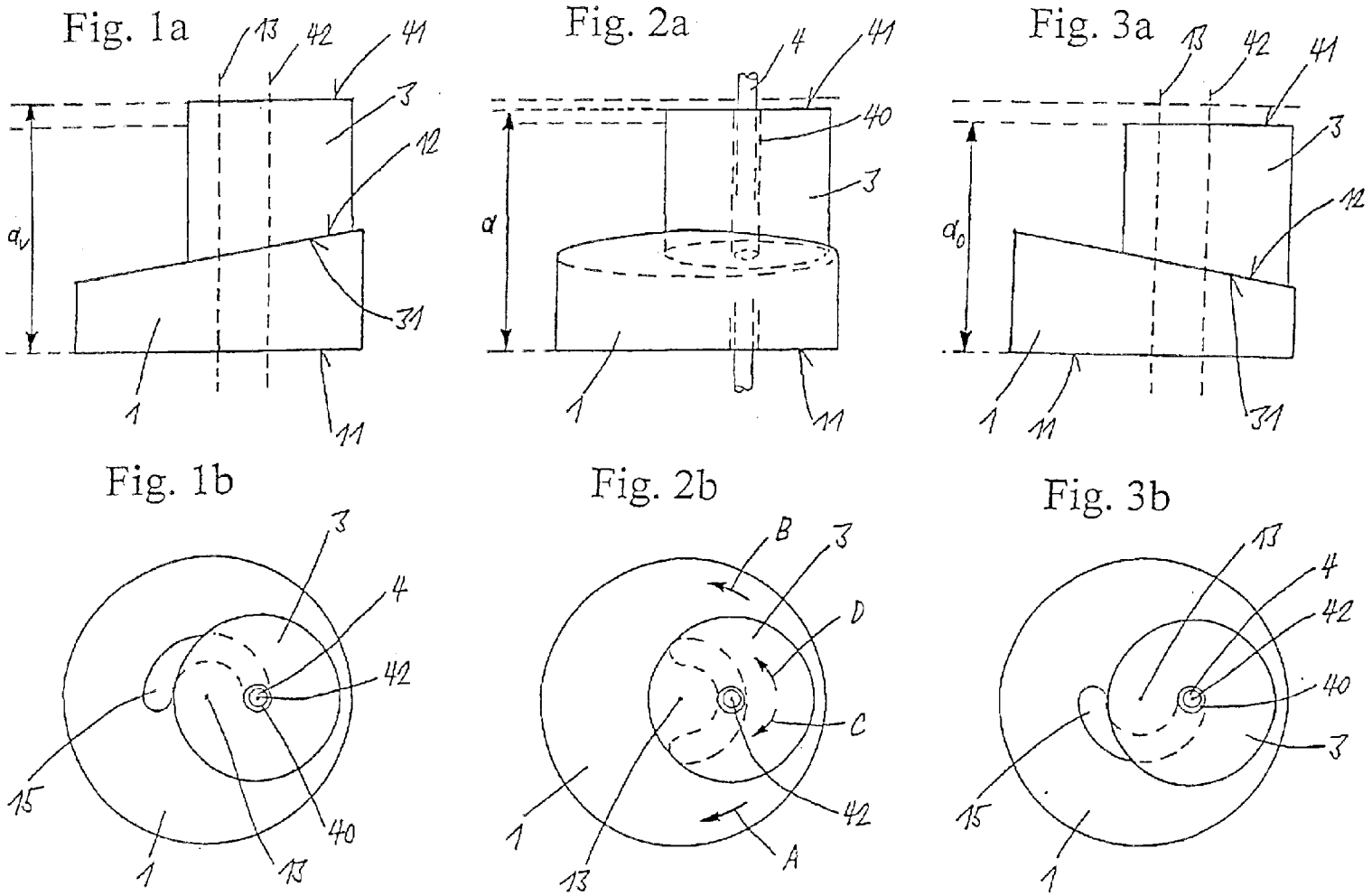
Figure 4:
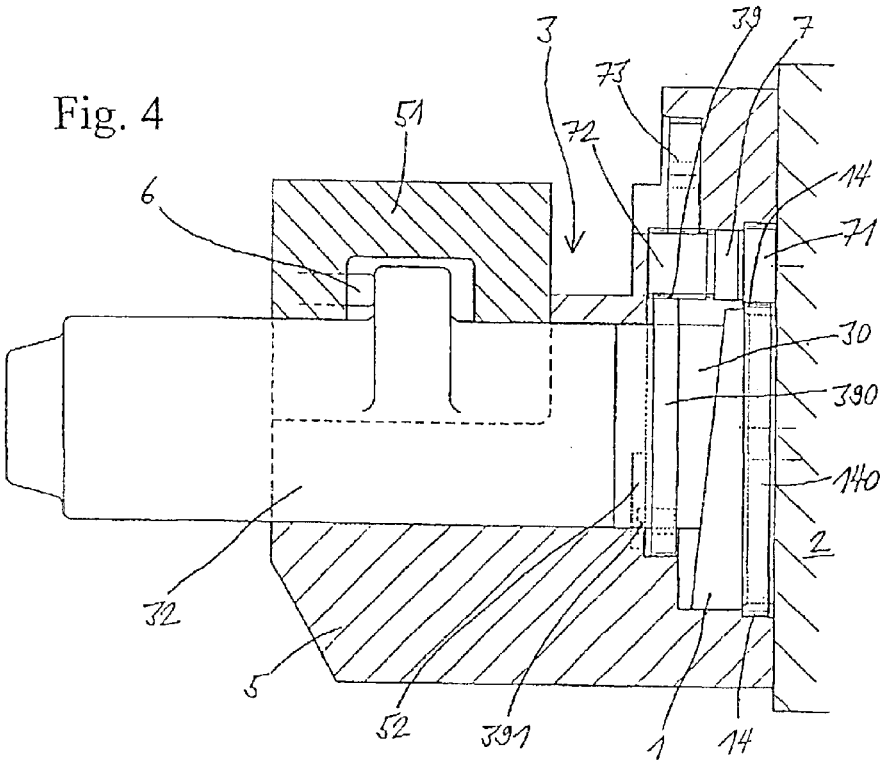
FIG. 4 shows a partial sectional view of the setting device arranged in the forming machine on the punch side according to the first exemplary embodiment.

FIGS. 1*a* and 1*b* show the setting device at full stroke $a_v$ with the ejector 4 at one end of the curved through-slot 15. By a rotation of the rotary wedge disk 1 and of the pressure piece 3 according to the arrows A and C, respectively, by 90° in each case, an average stroke a according to FIGS. 2*a* and 2*b* is achieved. In the process, the end face 31 of the pressure piece 3 has been displaced relative to the rotary wedge disk 1 eccentrically to the rotation axis 13 of the latter, which can clearly be seen from the position of the pressure piece 3 relative to the curved through-slot 15. The relative displacement is effected by the rotation of the rotary wedge disk 1 under the pressure piece 3. By further rotation of the rotary wedge disk 1 and of the pressure piece 3 by a further 90°, the 0-stroke $a_0$ according to FIGS. 3*a* and 3*b* is achieved, at which the ejector 4 is located at the other end of the curved through-slot 15. The stroke is correspondingly increased by rotating the rotary wedge disk 1 and the pressure piece 3 in the direction of the arrows B and D.

The following stipulation applies to the entire further description. If reference numerals are contained in a figure for the sake of clarity of the drawing but are not explained in the directly associated text of the description, reference is made to the fact that they are mentioned in preceding descriptions of the figures.

FIGS. 4 to 9

In the first exemplary embodiment, the pressure piece 3 comprises a rotatable part 30 and a rotationally fixed pressure part 32, which is arranged in a mounting part 5 having a removable lid 51, for example a punch holder with punch-holder lid. By means of a clamping element 6, e.g. a screw, the pressure part 32 and thus indirectly the rotary part 30 and the rotary wedge disk 1 are clamped in the direction of the parent body 2, against which the rotary wedge disk 1 bears with its bearing surface 11. To adjust the stroke of the setting device, the clamping element 6 is released and is tightened again after the rotation of the rotary wedge disk 1 and the rotary part 30. During the adjustment of the stroke, only the rotary wedge disk 1 and the rotary part 30 are rotated, whereas the pressure part 32 connected to the rotary part 30 via sliding surfaces 33, 34 does not rotate, so that the tool attached directly or indirectly thereto is not rotated.

Figure 9:
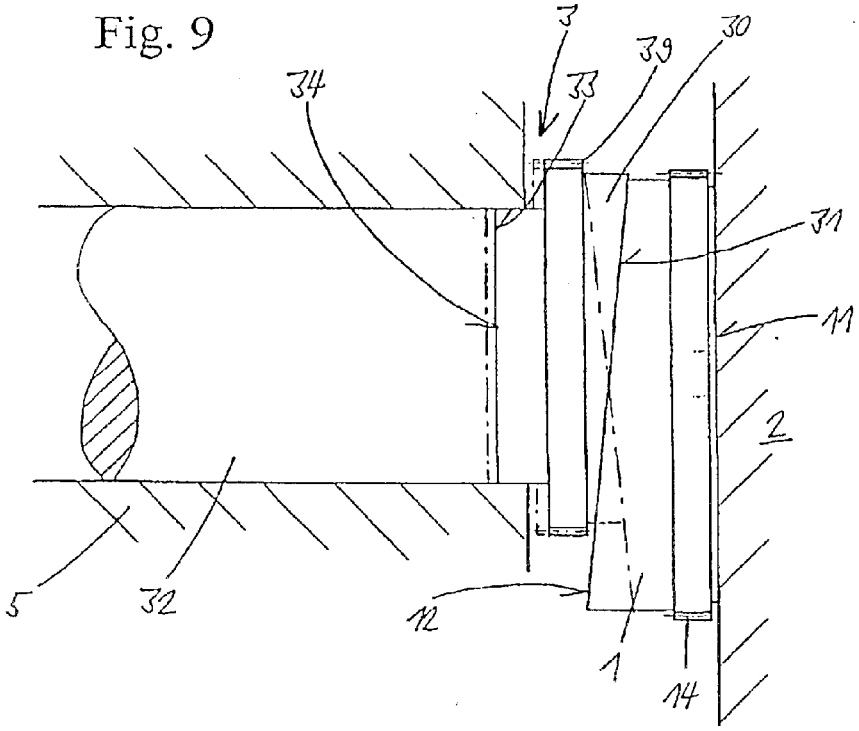
FIG. 9 shows a partial sectional view of part of the setting device arranged in the forming machine according to the first exemplary embodiment, having a pressure piece comprising a pressure part and a rotary part which are connected via flat sliding surfaces.

In FIG. 9, in addition to the situation at O-stroke, the situation at full stroke is also shown by dot-dash lines.

The bearing surface 11 of the rotary wedge disk 1 is circular and rotates on the spot on the parent body 2 when the rotary wedge disk 1 is rotated. The rotary wedge disk therefore always rotates in the impression recess possibly produced during the forming and never comes to lie above an edge of the impression recess.

To rotate the rotary wedge disk 1, a toothed rim 14, which extends over an angle of approximately 180°, is arranged on the rotary wedge disk 1. The toothed rim 14 is part of a ring 140, which is fastened to the rotary wedge disk 1 in a removable manner by means of three driving pins 141.

The angle of inclination of the inclined plane 12 relative to the bearing surface 11 is smaller than the limit angle for self-locking, and is advantageously 10° at most, so that unintentional displacement of the end face 31 on the inclined plane 12 is prevented. The result of this, however, is that, when the rotary wedge disk 1 is rotated, the rotary part 30 is not automatically rotated with it, but has to be separately driven. For this purpose, the rotary part 30 is provided with a toothed rim 39 which extends over an angle of approximately 180°. The toothed rim 39 is part of a ring 390, to which a driving peg 391 is screwed by means of a screw 392. The driving peg 391 serves, on the one hand, to connect the toothed rim 39 to the rotary part 30, and, on the other hand, a part of it is located in a curved groove 52 in the mounting part 5. The curved groove 52 extends over an angle of less than 180°, for example 175°, so that its ends act as a stop for the driving peg 391 and thus result in a rotary limit.

The rotary wedge disk 1 and the rotary part 30 are driven via two pinions 71 and 72, respectively, which are arranged on the same shaft 7 and engage in the toothed rims 14 and 39, respectively. The shaft 7 in turn is driven by a drive pinion 73 which is in engagement with the pinion 72 and can be actuated in motor-driven manner or with a hand tool, e.g. a square wrench. In order to be able to arrest the rotary wedge disk 1 and the rotary part 30 in each adjustable position, a pivotable toothed lever 74 is attached in the mounting part 5, this pivotable toothed lever 74 being pressed by a spring 75 onto the drive pinion 73 and blocking the latter in this way. Before the drive pinion 73 is actuated, the toothed lever 74 therefore has to be pushed or pulled away from the drive pinion 73, e.g. by the hand tool.

To show the stroke of the setting device, an indicating dial 76, which is provided with a stroke scale, is attached in front of the drive pinion 73. The rotary position of the drive pinion 73 can be read off directly thereon. The zero position of the stroke scale corresponds to the average stroke position shown in FIGS. 2*a* and 2*b*.

Figure 5:
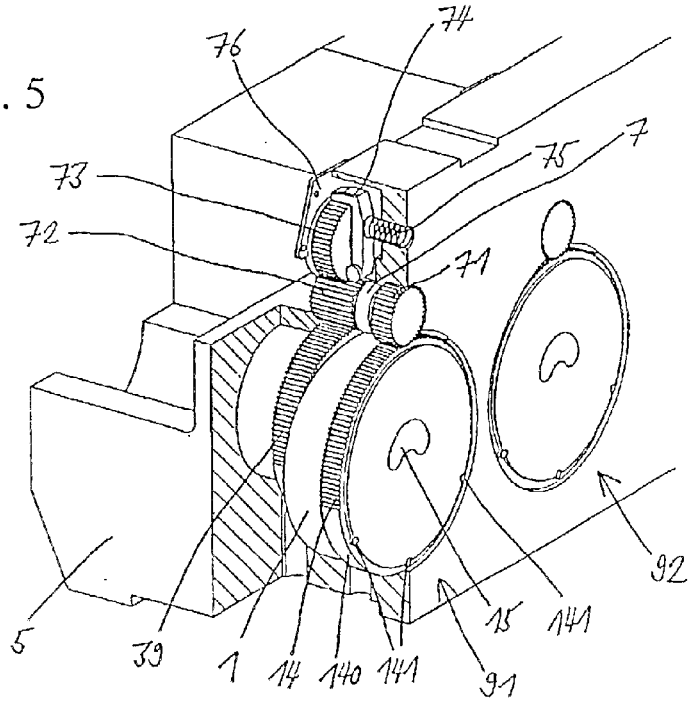
FIG. 5 shows a perspective view of part of the first exemplary embodiment of the forming machine, having two setting devices arranged next to one another.
Figure 6:
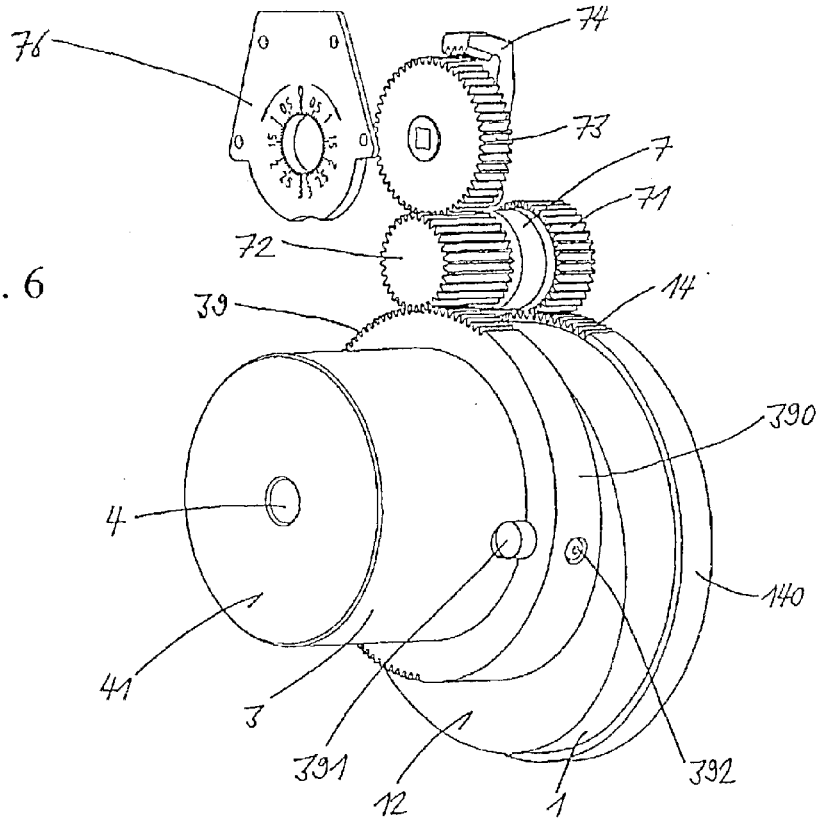
FIG. 6 shows a perspective view of a setting device of the forming machine of FIG. 5.
Figure 7:
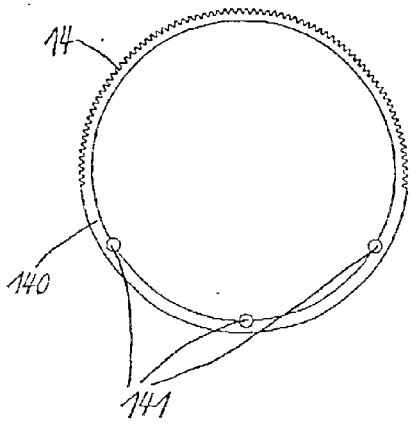
FIG. 7 shows a plan view of the toothed rim with drivers of the rotary wedge disk of the setting device according to the first exemplary embodiment.
Figure 8:
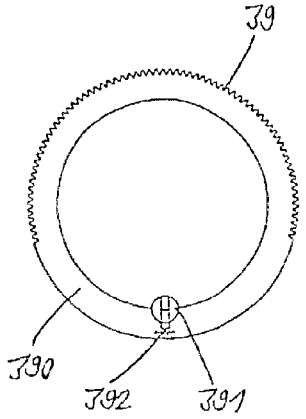
FIG. 8 shows a plan view of the toothed rim with driver of the rotary part of the setting device according to the first exemplary embodiment.

The forming machine according to the first exemplary embodiment has a plurality of forming stations arranged next to one another, two forming stations 91, 92 being shown in FIG. 5. Each forming station 91, 92 is provided with a device for setting the axial position of one of the tools, i.e. of the punch or the die.

Figure 10:
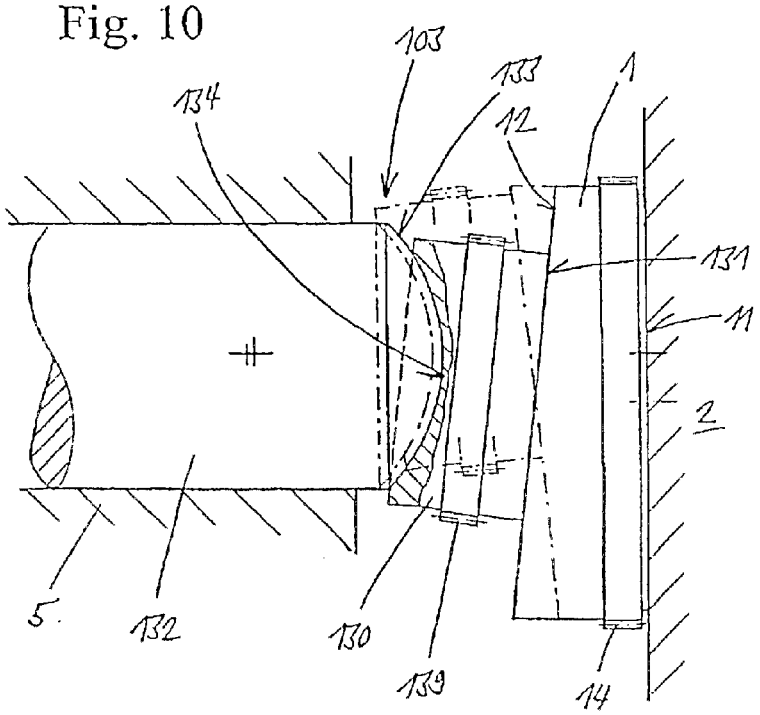
FIG. 10 shows a partial sectional view of part of the setting device arranged in the forming machine according to a second exemplary embodiment, having a pressure piece comprising a pressure part and a rotary part which are connected via sliding surfaces in the form of spherical-surface sections.

Second Exemplary Embodiment—FIG. 10

In this second exemplary embodiment, in addition to the situation at 0-stroke, the situation at full stroke is again also shown by dot-dash lines. The rotary wedge disk 1 with bearing surface 11, inclined plane 12 and toothed rim 14 corresponds to the first exemplary embodiment. A pressure piece 103 is composed of a rotationally fixed pressure part 132 and a rotatable part 130 with toothed rim 139 and end face 131. The essential difference from the first exemplary embodiment consists in the fact that the pressure part 132 is provided with a sliding surface 133 in the form of a convex spherical-surface section and the rotary part 130 is provided with a sliding surface 134 which bears against the sliding surface 133 and is in the form of a concave spherical-surface section complementary thereto. These two sliding surfaces 133, 134 in the form of spherical-surface sections make it unnecessary for the rotary part 130 to be rotated in accordance with the rotary wedge disk 1. On the contrary, the rotary part 130 may be driven independently of the rotary wedge disk 1, or a rotary drive may even be completely dispensed with.

The comments made with reference to the first exemplary embodiment correspondingly apply to the rest of the second exemplary embodiment.

Third Exemplary Embodiment—FIG. 11

In this third exemplary embodiment, in addition to the situation at 0-stroke, the situation at full stroke is again also shown by dot-dash lines. The rotary wedge disk 1 with bearing surface 11, inclined plane 12 and toothed rim 14 corresponds to the first exemplary embodiment. A pressure piece 203 is composed of a rotationally fixed pressure part 232 and a rotatable part 230 which are connected via flat first sliding surfaces 233 and 234, respectively. The rotary part 230 comprises an end-face part 235 having an end face 231 and an articulation part 236 connected thereto via second sliding surfaces 237 and 238, respectively, and having the first sliding surface 234. For its drive, the articulation part 236 is provided with a toothed rim 239 in accordance with the toothed rim 39 of the first exemplary embodiment. The second sliding surfaces 237, 238 have the form of a convex cylinder-envelope section and, respectively, a concave cylinder-envelope section complementary thereto. In this way, the end-face part 235, when the rotary wedge disk 1 and the articulation part 236 are rotated simultaneously and by the same angle, is rotated by the articulation part 236.

The comments made with reference to the first exemplary embodiment correspondingly apply to the rest of the third exemplary embodiment.

Fourth Exemplary Embodiment—FIG. 12

In this fourth exemplary embodiment, in addition to the situation at 0-stroke, the situation at full stroke is again also shown by dot-dash lines. The rotary wedge disk 1 with bearing surface 11, inclined plane 12 and toothed rim 14 corresponds to the first exemplary embodiment. A pressure piece 303 is composed of a rotationally fixed pressure part 332 and a rotatable part 330 which are connected via flat first sliding surfaces 333 and 334, respectively. The rotary part 330 comprises an end-face part 335 having an end face 331 and an articulation part 336 connected thereto via second sliding surfaces 337 and 338, respectively, and having the first sliding surface 334. For its drive, the articulation part 336 is provided with a toothed rim 339 in accordance with the toothed rim 39 of the first exemplary embodiment. Unlike the third exemplary embodiment, the second sliding surfaces 337, 338 here have the form of a convex spherical-surface section and, respectively, a concave spherical-surface section complementary thereto. These two sliding surfaces 337, 338 in the form of spherical-surface sections make it unnecessary for the articulation part 336 to be rotated in accordance with the rotary wedge disk 1. On the contrary, the articulation part 336 may be driven independently of the rotary wedge disk 1 or a rotary drive may even be completely dispensed with.

The comments made with reference to the first exemplary embodiment correspondingly apply to the rest of the fourth exemplary embodiment.

Further design variations can be realized for the above-described forming machines having devices for setting the axial position of a tool. The following may be specifically mentioned here:

In principle, the pressure piece 3, 103, 203 or 303 may also be arranged axially in a fixed position and the rotary wedge disk 1 may be arranged so as to be axially displaceable together with the parent body 2.

The pressure part 32, 132, 232 or 332 need not be rotationally fixed in all cases. If the associated tool may be rotated, the pressure part 32, 132, 232 or 332 may be rotatable. It can thus also be designed, for example, in one piece with the rotary part 30 or the articulation part 236 or 336.

The rotary part 30 or 130 and the toothed rim 39 or 139, respectively, could be designed in such a way that the rotary part 30; 130 can be removed from the toothed rim 39; 139 remaining in the mounting part 5 and can be pushed into said toothed rim 39; 139 again. The drive of the device for setting the axial position can thus remain in the mounting part 5 upon removal of the rotary part 30; 130 if it is not necessary to repair the drive.

The mounting part 5 may also be of multi-piece design in the direction of the adjustment; that is to say that, for example, it may consist of a part for mounting the pressure part 32; 132; 232; 332 and of a part for mounting the rotary wedge disk 1 and the rotary part 30; 130; 230; 330.

What is claimed is:

1. A forming machine comprising at least one forming station having a punch and a die as tools and a device for setting the axial position of one of the two tools, the device comprising an adjusting wedge having a bearing surface which bears against a parent body, wherein the adjusting wedge is a rotary wedge disk which is rotatable about a rotation axis and which has the bearing surface on one disk side and an inclined plane on the other disk side, and the device also comprises a pressure piece having an end face which bears against the inclined plane in such a way that it is displaced relative to the rotary wedge disk eccentrically to the rotation axis when the rotary wedge disk is rotated, the axial distance between pressure piece and parent body changing in the process.

2. The forming machine as claimed in claim 1, wherein the bearing surface is circular and rotates on the spot on the parent body when the rotary wedge disk is rotated.

3. The forming machine as claimed in claim 1, wherein there is arranged on the rotary wedge disk a toothed rim, via which said rotary wedge disk can be rotated.

4. The forming machine as claimed in claim 1, wherein the angle of inclination of the inclined plane relative to the bearing surface is 10° at most.

5. The forming machine as claimed in claim 1, wherein the pressure piece comprises a rotatable part having the end face and a rotationally fixed pressure part connected thereto via first sliding surfaces.

6. The forming machine as claimed in claim 5, wherein the first sliding surfaces have the form of a convex spherical-surface section and, respectively, a concave spherical-surface section complementary thereto.

7. The forming machine as claimed in claim 5, wherein the rotary part comprises an end-face part having the end face and an articulation part connected thereto via second sliding surfaces and having one of the first sliding surfaces.

8. The forming machine as claimed in claim 7, wherein the second sliding surfaces have the form of a convex cylinder-envelope or spherical-surface section and, respectively, a concave cylinder-envelope or spherical-surface section complementary thereto.

9. The forming machine as claimed in claim 5, further comprising means for rotating the rotary part or, if present, the articulation part coupled to the rotary wedge disk, these means comprising a toothed rim which is arranged on the rotary part or, if present, on the articulation part.

10. The forming machine as claimed in claim 1, wherein the pressure piece and the rotary wedge disk have a through-hole and/or a curved through-slot for an ejector.

* * * * *